US010550520B2

(12) United States Patent
Gélinas

(10) Patent No.: US 10,550,520 B2
(45) Date of Patent: Feb. 4, 2020

(54) METHOD WITH A HORIZONTAL JET APPLICATOR FOR A PAPER MACHINE WET END

(71) Applicant: GL&V Canada Inc., Trois-Rivières (CA)

(72) Inventor: Pierre Gélinas, Trois-Rivières (CA)

(73) Assignee: GL&V CANADA INC., Trois-Rivieres (CA)

( * ) Notice: Subject to any disclaimer, the term of this patent is extended or adjusted under 35 U.S.C. 154(b) by 0 days.

(21) Appl. No.: 16/370,431

(22) Filed: Mar. 29, 2019

(65) Prior Publication Data

US 2019/0309481 A1 Oct. 10, 2019

Related U.S. Application Data

(60) Provisional application No. 62/652,988, filed on Apr. 5, 2018.

(51) Int. Cl.
*D21H 23/50* (2006.01)
*D21H 19/10* (2006.01)

(52) U.S. Cl.
CPC ..... *D21H 23/50* (2013.01); *D21H 19/10* (2013.01)

(58) Field of Classification Search
None
See application file for complete search history.

(56) References Cited

U.S. PATENT DOCUMENTS

| | | | |
|---|---|---|---|
| 4,141,789 | A | 2/1979 | Justus |
| 4,285,787 | A | 8/1981 | Garner et al. |
| 4,927,499 | A | 5/1990 | Wikman |
| 5,792,317 | A | 8/1998 | Taylor et al. |
| 5,985,030 | A | 11/1999 | Taylor et al. |
| 7,279,043 | B2 | 10/2007 | Krageloh et al. |
| 2016/0305070 | A1 | 10/2016 | Prescott |
| 2017/0284030 | A1* | 10/2017 | Svending ..... D21H 11/04 |

FOREIGN PATENT DOCUMENTS

| | | | |
|---|---|---|---|
| CA | 2056849 | A1 | 6/1992 |
| DE | 102005000004 | A1 | 7/2006 |
| EP | 2017383 | A2 | 7/2008 |

* cited by examiner

*Primary Examiner* — Michael P. Rodriguez
(74) *Attorney, Agent, or Firm* — James Earl Lowe, Jr.

(57) ABSTRACT

A method applying additives to a forming web of paper fiber by pumping an additive through a channel in an applicator to a horizontal slot with a vertical gap of less than 0.100 inch at a rate of less than 5 US gallons per minute per inch of the slot, the additive leaving the slot in a substantially horizontal direction above the forming web traveling in a substantially horizontal direction.

16 Claims, 2 Drawing Sheets

METHOD WITH A HORIZONTAL JET APPLICATOR FOR A PAPER MACHINE WET END

CROSS-REFERENCE TO RELATED APPLICATIONS

This application claims the benefit of and priority to prior Application No. 62/652,988 filed 5 Apr. 2018.

BACKGROUND

This application is directed to methods of applying additives to a forming web of paper fiber at a paper machine wet end.

Direct application of highly fibrillated cellulose or other additives to a sheet surface of a forming paper web can greatly enhance the surface properties and provide a superior surface for coating applications. Highly fibrillated cellulose or other additives can be applied with a vertical curtain falling by gravity, but the curtain has a much lower velocity in the machine direction than the forming paper web on which it lands, which causes significant extension of the additive layer and causes stresses and disruptions both in this layer and in the top surface of the paper web. Pressurizing the applicator to increase the velocity of the vertical curtain causes the curtain to partially penetrate and disrupt the forming paper web as it lands. Known alternative technology to apply liquid horizontally on a paper machine wet end is a secondary headbox, used for making multi-ply paper grades. However, this technology is not suitable for adding additives such as highly fibrillated cellulose for two reasons.

The very small-scale fibers or particles such as fibrillated cellulose must be kept in high speed, micro-turbulent flow during the entire delivery period to prevent settling out and to maintain a good fluid dispersion. For this purpose, a conventional headbox slice zone, with a large converging channel ending with an essentially vertical top slice lip, is not suitable. See, for example, U.S. Pat. No. 7,279,043. Other patents disclosing conventional headboxes include U.S. Pat. Nos. 4,141,789 or 4,285,787.

The minimum flow rates possible with secondary headbox technology are too high, meaning that significant extra drainage capacity would be needed on the paper machine wet end to drain the additional water load, or the machine speed would have to be significantly reduced.

U.S. Pat. Nos. 5,792,317 and 5,985,030 disclose an applicator for applying a suspension of uncooked starch or other additives in the form of a curtain to a forming web on a paper machine. In these patents an additive is forced out of a narrow slot in the applicator and falls downward onto the forming paper web.

SUMMARY

In this disclosure a special applicator has been developed in which the flow of additives from a mixing chamber passes through a narrow, essentially parallel slot that is oriented in a horizontal, or nearly horizontal direction, and forms a full width jet which then lands on the forming paper web. By adjusting the pressure in the applicator, it is possible to adjust the velocity of the essentially horizontal jet relative to the velocity of the paper web, and therefore to land the jet of additive on the forming web without disruption.

DRAWINGS

DETAILED DESCRIPTION OF THE DISCLOSURE

Figure 1:
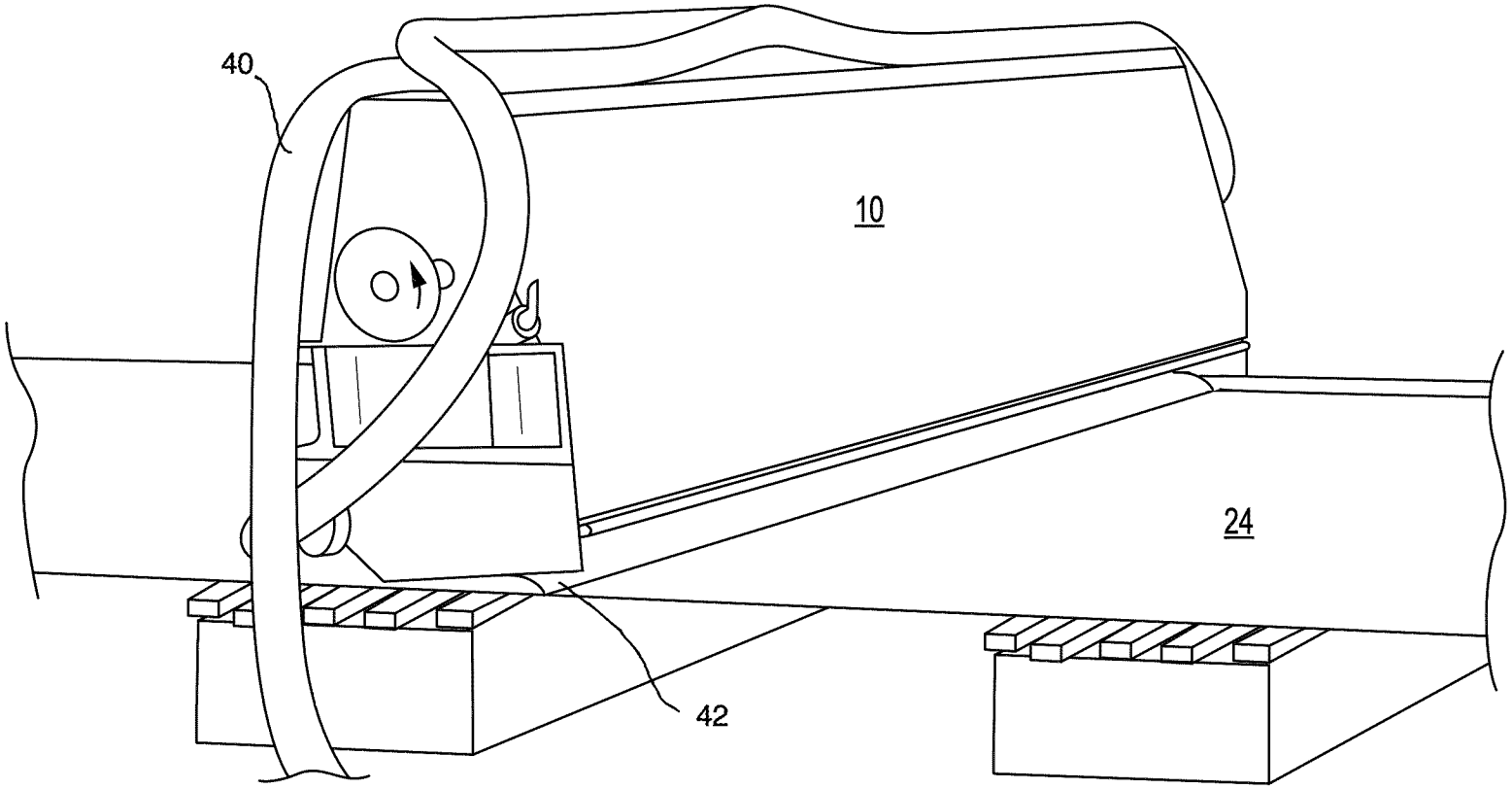
FIG. 1 is a perspective front view of an applicator applying a uniform application of an additive to a forming web of paper fiber.

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention, which is defined by the claims.

Illustrated in the drawings is a method of applying an additive such as microfibrils to a forming web 24 of paper fiber comprising the steps of: creating a an additive comprising microfibrils in a fluid, then pumping the additive through a channel in an applicator 10 to a horizontal slot 17 with a vertical gap height of less than 0.100 inch at a rate of less than 5 US gallons per minute per inch of the slot. The additive leaves the slot at 42 in a substantially horizontal direction above the forming web traveling in a substantially horizontal direction. The less than 0.100 inch substantially horizontal gap is at lips 20 and 22 (see FIG. 2). This gap height needs to be set to get the required flow at a speed needed to maintain a good formation.

The special applicator 10 is positioned over the wire section of a paper machine, as illustrated in FIG. 1, with an adjustable support structure and an additive supply system 40. A liquid dispersion or solution of cellulose nanofibers (CNF), micro-fibrillated cellulose (MFC), other forms of highly fibrillated cellulose (FC), or other additives is forced out of the narrow slot 17 in the applicator 10 as a full-width, essentially horizontal jet and lands on the forming web of the paper machine.

The use of bio-based and renewable CNF, MFC or other forms of highly fibrillated cellulose offers a wide variety of benefits for the production of many paper grades.

Commercial machines run production web speeds of about 500-3000 feet per minute. A vertical curtain falling by gravity has a much lower machine direction velocity than the forming paper web on which it lands, which causes significant extension of the additive layer and causes stresses and disruptions both in this layer and in the top surface of the paper web. Pressurizing an applicator to increase the velocity of the vertical curtain causes the curtain to partially penetrate and disrupt the forming paper web as it lands. Angling the curtain applicator away from true vertical is not enough to overcome this effect.

In this disclosure the special applicator 10 has been developed in which the flow of additives from an expansion chamber 14 passes through a narrow, essentially parallel slot 17 that is oriented in a horizontal, or nearly horizontal direction, and forms a full width jet which then lands on the forming paper web. By adjusting the pressure in the applicator and the slot gap height, it is possible to adjust the velocity of the essentially horizontal jet relative to the velocity of the paper web, and therefore to land the jet of additive on the forming web without disruption. Long, essentially parallel lips 20 and 22 provide the correct exit required for the applicator 10 for this type of material.

Figure 2:
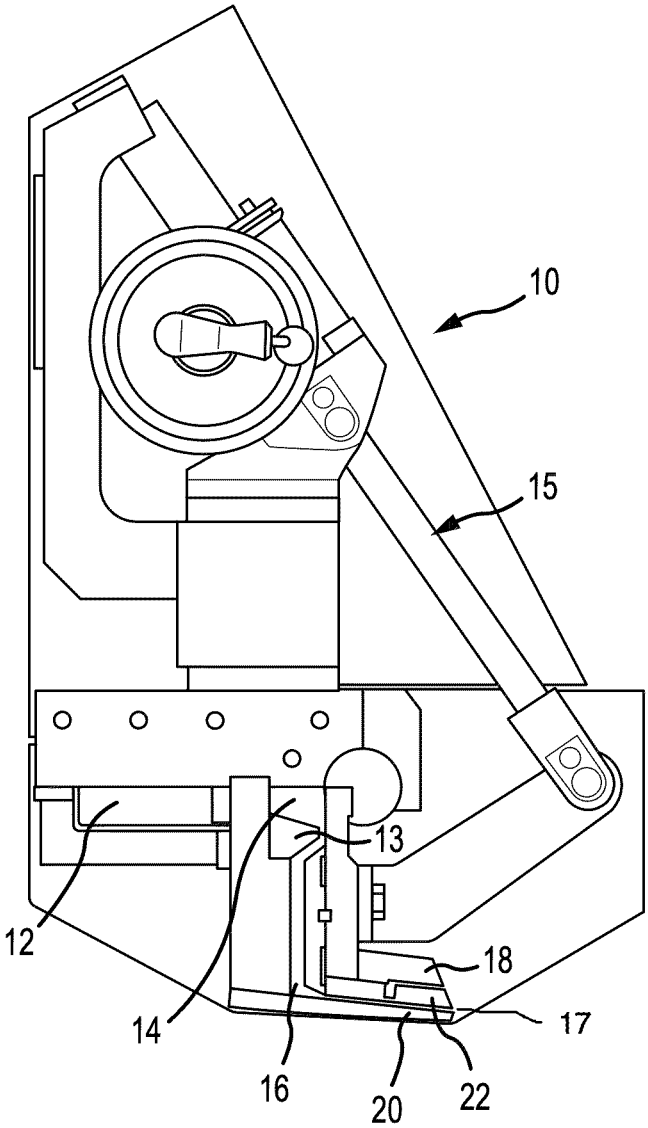
FIG. 2 is a cross sectional side view of the applicator illustrated in FIG. 1.

As illustrated in FIG. 2, in a preferred embodiment of this disclosure, the essentially parallel lips 20 and 22 that form the slot 17 has an angle between the top and bottom surfaces of less than 3 degrees. The disclosed method applies the additive at the highest consistency possible to reduce the water load on the table.

The additive is feed to the applicator 10 through a feed system 40. In a preferred embodiment, the applicator body 10 includes a knuckle and jack mechanism 15 that allows rapid opening and closing of a lip holder 18 for help in cleaning the applicator.

FC (or CNF or MFC) has the property of being highly viscous at relatively low consistency. It also has a unique property of being shear thinning. This means the disclosed method pumps FC up to around 4% (maximum) by weight of the FC in fluid but the disclosed method further dilutes the FC to be able to uniformly apply it at the surface of the paper (or board).

Testing has confirmed that good results are obtained at below 1.5% consistency with the disclosed applicator. Since one should not overload the wet end of the paper machine with this very slow draining material, the disclosed method minimizes the addition of water to FC, as manufactured.

FC is very expensive to produce and most of the applications will apply less than 10% in weight. When translated into flow, this means a flow range below 5 USGPM (US Gallons per Minute) per inch of slot. For example, on a commercial paper machine, this translates into a slot/gap (or parallel lips) that should be less than 0.100-inch-wide, and preferably between 0.015 to 0.060-inches-wide. To get the shear thinning effect, the applicator 10 includes the two long parallel or almost parallel lips 20 and 22 to create the gap. This provides enough shear to the material to get an even and nice jet, as illustrated in FIG. 1. This small gap requires a lot more precision in manufacturing to maintain a uniform flow across the entire machine.

As illustrated in FIG. 2, the FC enters a distribution chamber 12, where it then passes through spaced apart tubes (not shown) into an expansion chamber 14. From there, the FC accumulates behind a restriction 13 to insure its even distribution through an about 0.120-inch channel into a nozzle chamber 16. From the nozzle chamber 16, the FC gets distributed evenly across and through a slot formed by the substantially parallel lips 20 and 22, so the FC falls 42 evenly onto the passing web 24, as illustrated in FIG. 1.

All of the chambers inside the applicator 10 need to be very small to keep the diluted FC fluid to avoid any deposition or accumulation (all internal gaps are below 0.5 inch). These accumulations, if produced, will plug the opening of the parallel slices and produce skips or streaks. That is why the disclosed method maintains this internal micro turbulence.

A Standard headbox is not designed to run at less than 5 USGPM per inch (preferably around 1 to 2 USGPM per inch). It is designed to have a convergence angle in its nozzle of more than 3 degrees (not parallel or almost parallel) and all its internals are way too large to maintain micro-turbulence to the low flow of FC. If one were to use a standard headbox, the FC would need to be diluted a lot more and would negatively affect the wet end of the paper machine.

Various other features and advantages of the invention will be apparent from the following claims.

The invention claimed is:

1. A method of applying additive to a forming web of paper fiber, the method comprising pumping an additive in a fluid through a channel in an applicator to a horizontal slot with a vertical gap height of less than 0.100 inch at a rate of less than 5 US gallons per minute per inch of the slot, the additive leaving the slot in a substantially horizontal direction above the forming web traveling in a substantially horizontal direction;

wherein the additive is microfibril; and wherein the velocity of the additive leaving the slot is about the same as the speed of the forming web traveling in the substantially horizontal direction.

2. The method according to claim 1 wherein the slot is formed from long, essentially parallel lips.

3. The method according to claim 2 wherein the essentially parallel lips have an angle between the top surface of the bottom lip and the bottom surface of the top lip of less than 3 degrees.

4. The method according to claim 1 wherein the percent by weight of the additive in fluid is less than about 4%.

5. The method according to claim 4 wherein the percent by weight of the additive in fluid is less than about 1.5%.

6. The method according to claim 1 wherein the slot gap height is between 0.015 and 0.060-inches.

7. The method according to claim 1 wherein the additive enters the applicator through an expansion chamber where the additive then accumulates behind a restriction to insure its even distribution through an about 0.120-inch channel into a nozzle chamber where the additive then gets distributed evenly across and through the horizontal slot.

8. The method according to claim 7 wherein applicator chambers inside the applicator through which the additive passes are small enough to keep the additive fluid.

9. The method according to claim 8 wherein flow inside the applicator maintains micro turbulence of the additive.

10. The method according to claim 1 wherein pumping is at a rate of between 1 to 2 US gallons per minute per inch of the slot.

11. A method of applying microfibrils to a forming web of paper fiber, the method comprising pumping microfibrils in a fluid through a channel in an applicator to a horizontal slot with a gap height between 0.015 and 0.060-inches at a rate of rate of between 1 to 2 US gallons per minute per inch of the slot, the slot being formed from long, essentially parallel lips so that shear thinning of the microfibrils occurs, the microfibrils in a fluid leaving the slot in a substantially horizontal direction above the forming web traveling in a substantially horizontal direction with the velocity of the microfibrils in a fluid leaving the slot at about the same as the speed of the forming web traveling in the substantially horizontal direction.

12. The method according to claim 11 wherein the percent by weight of the microfibrils in a fluid is less than about 1.5%.

13. The method according to claim 12 wherein the microfibrils in a fluid enters the applicator through an expansion chamber where the microfibrils in a fluid then accumulates behind a restriction to insure its even distribution through an about 0.120-inch channel into a nozzle chamber where the microfibrils in a fluid then gets distributed evenly across and through the horizontal slot.

14. The method according to claim 13 wherein applicator chambers inside the applicator through which the microfibrils in a fluid passes are small enough to keep the microfibrils in a fluid, fluid.

15. The method according to claim 14 wherein flow inside the applicator maintains micro turbulence of the microfibrils in a fluid.

16. The method according to claim 11 wherein the essentially parallel lips have an angle between the top surface of the bottom lip and the bottom surface of the top lip of less than 3 degrees.

* * * * *